US006119685A

United States Patent [19]

Kawashima et al.

[11] Patent Number: 6,119,685

[45] Date of Patent: Sep. 19, 2000

[54] DIVING SNORKEL

[75] Inventors: Haruo Kawashima; Minoru Takeuchi; Kenji Kawana, all of Tokyo, Japan

[73] Assignee: Tabata Co., Ltd., Tokyo, Japan

[21] Appl. No.: 09/245,676

[22] Filed: Feb. 8, 1999

[30] Foreign Application Priority Data

Feb. 18, 1998 [JP] Japan ..... 10-036427

[51] Int. Cl.[7] ..... B63C 11/16

[52] U.S. Cl. ..... 128/201.11; 128/201.27; 128/201.28

[58] Field of Search ..... 128/201.11, 201.27, 128/201.28, 205.22; 446/18, 21

[56] References Cited

U.S. PATENT DOCUMENTS 4,834,084 5/1989 Walsh .
4,872,453 10/1989 Christianson ..... 128/201.11
4,884,564 12/1989 Lamont ..... 128/201.11

FOREIGN PATENT DOCUMENTS 2039748 3/1980 United Kingdom ..... 128/201.11
91/09772 7/1991 WIPO ..... 128/201.11

*Primary Examiner*—John G. Weiss
*Assistant Examiner*—V. Srivastava
*Attorney, Agent, or Firm*—Baker & Daniels

[57] ABSTRACT

A snorkel which includes a main conduit having an upper opening as well as a lower opening and a branch conduit branched from the main conduit. The branch conduit is formed at its top with a mouthpiece and a proximal end of the branch pipe is introduced into the main conduit, then curved toward the upper opening, and thereby eliminates swimmer physical fatigue due to purge diving use of the snorkel.

4 Claims, 2 Drawing Sheets

DIVING SNORKEL

BACKGROUND OF THE INVENTION

This invention relates to diving snorkels such as used by divers and swimmers.

Conventional diving snorkels comprise a main conduit having an upper opening for lying above the water surface during actual use of the snorkel and a lower opening lying under the water surface during actual use of the snorkel and are provided with a non-return valve adapted to be opened downwards, and a branch conduit branched from the main conduit between the upper and lower openings' which' provided at its distal end with a mouthpiece.

U.S. Pat. No. 4,834,084 discloses the snorkel in which the main conduit is radially divided in two by a baffle plate provided immediately under the mouthpiece so that a swimmer's instantaneous vigorous expiration can be rapidly guided together with a quantity of water collected within the snorkel toward the upper opening.

With conventional snorkels inclusive of the one disclosed in the above-mentioned U.S. Patent, a quantity of water flowing into the snorkel through the upper opening flows down along an inner wall of the main conduit and is collected in the proximity of the mouthpiece. While the snorkel disclosed in the U.S. Patent allows such collected water to be forced out with relatively high efficiency, it is still impossible for this snorkel to prevent more or less significant quantity of water from being collected in the proximity of the mouthpiece. Accordingly, this snorkel of prior art requires a swimmer to make frequent fatiguing purges from the proximity of the mouthpiece by his or her expiration.

SUMMARY OF THE INVENTION

In view of the problem as has been described above, it is an object of the present invention to eliminate the necessity of such fatiguing purge from the proximity of the mouthpiece.

According to the invention, there is provided a diving snorkel comprising: a main conduit; a branch conduit; the main conduit having an upper opening and a lower opening provided with a non-return valve adapted to be opened downwards; the branch conduit having a proximal end entering into the main conduit, then extending in a direction defined by an axis connecting the lower opening to the upper opening and a distal end opened toward the upper opening so that an immediate extension of the proximal end is coaxially spaced apart from an inner peripheral wall of the main conduit and cooperates with the main conduit so as to form a double conduit.

DESCRIPTION OF THE PREFERRED EMBODIMENTS

Details of a diving snorkel according to the present invention will be more fully understood from the description given hereunder which is made with reference to the accompanying drawings.

Figure 1:
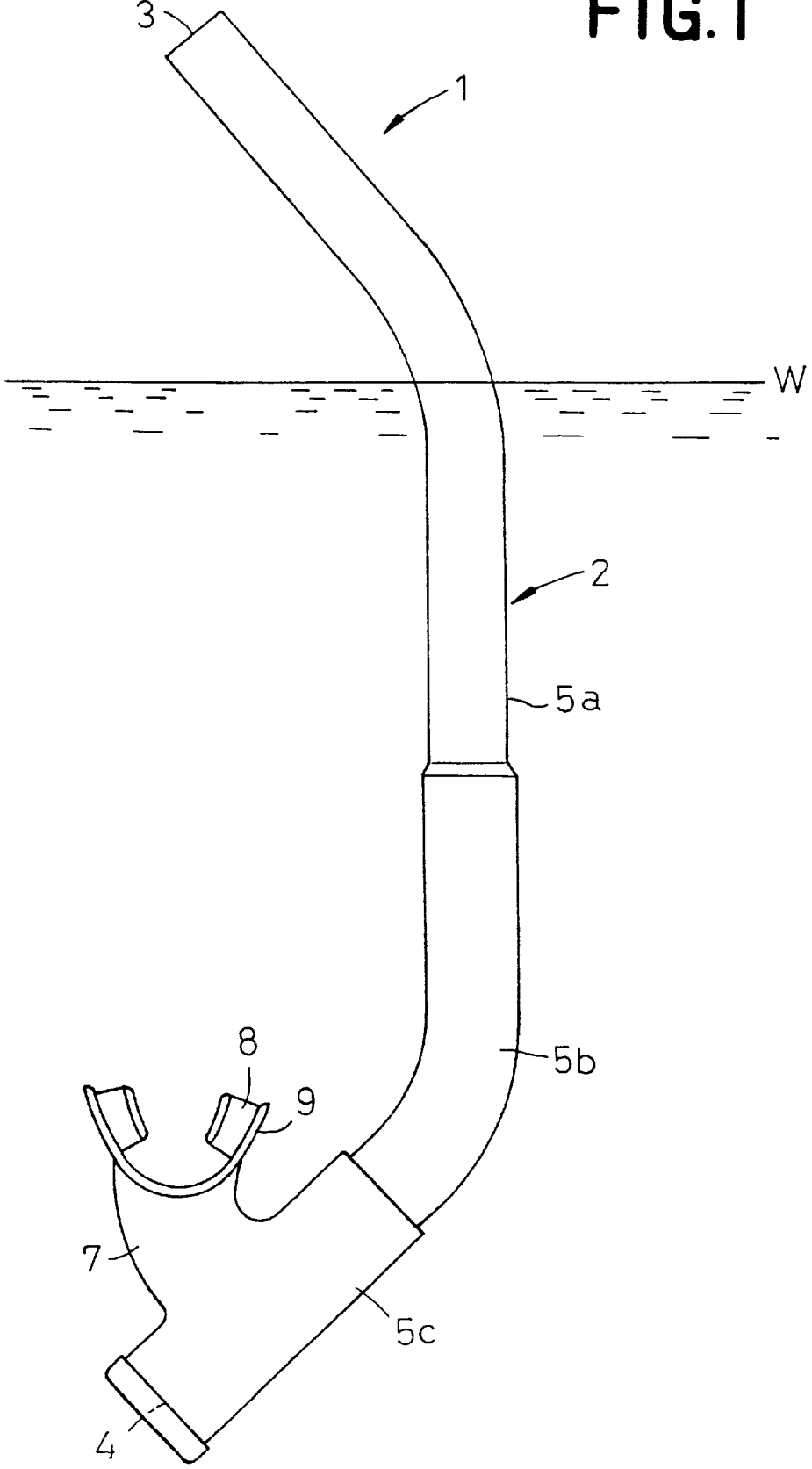
FIG. 1 is a side view of a diving snorkel according to the present invention.

FIG. 1 is a side view showing a diving snorkel and a position of the water surface W during actual use of the snorkel 1. The snorkel comprises a snorkel conduit 1 including a main conduit 2 and a branch conduit 7. The main conduit 2 includes an upper conduit 5*a*, an intermediate conduit 5*b* rotatably connected to the upper conduit 5*a* and a lower conduit 5*c* fixedly connected to the intermediate conduit 5*b*. The upper conduit 5*a* is curved at an intermediate portion thereof and has an upper opening 3. The intermediate conduit 5*b* is curved at an intermediate portion. The lower conduit 5*c* has a lower opening 4. The branch conduit 7 is branched from the lower conduit 5*c* and formed with a mouthpiece 9 including a breathing seat 8. The upper and intermediate conduits 5*a*, 5*b* are made from relatively hard materials such as synthetic resin. The lower conduit 5*c* and branch conduit 7 are integrally made from a relatively soft material such as rubber or synthetic resin.

Such snorkel allows a swimmer to breathe through the mouthpiece 9 held in his or her mouth so that a quantity of air aspirated by the swimmer may be taken in through the upper opening 3 lying above the water surface W and a quantity of air expired by the swimmer may be forced out also through the upper opening 3. A quantity of water having flown into the snorkel can be forced out through the upper opening 3 by instantaneous vigorous expiration of the swimmer. When the swimmer who has made a deep dive there after rises again toward the water surface W until the snorkel 1 restores its position as shown in FIG. 1, a quantity of water contained in the snorkel which is now partially exposed above the water surface W has a pressure sufficient to open a non-return valve 6 as will be described later in more detail and the quantity of water is purged out through the lower opening 4. A quantity of water remaining within the snorkel is then forced out by a swimmer's expiration.

Figure 2:
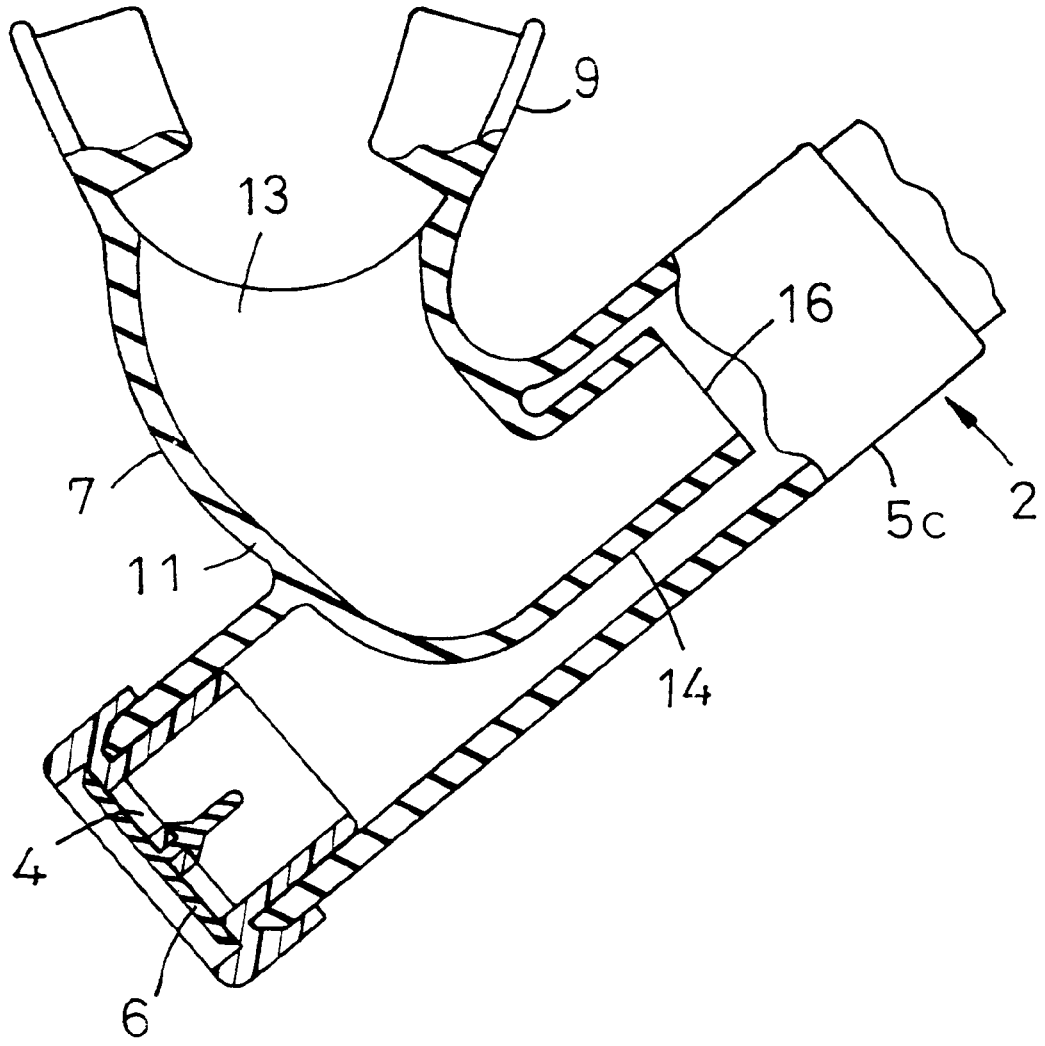
FIG. 2 is a side view showing a lower part of the snorkel as partially broken away.

FIG. 2 is a side view showing the snorkel in its proximity of the branch conduit 7 as partially broken away. The branch conduit 7 has, at its top, a breathing seat 13 and the mouthpiece 9. The branch conduit 7 extending from the lower conduit 5*c* is formed at a proximal end 11 of the branch conduit 7 with a conduit section 14 which is introduced into the lower conduit 5*c* and then curved upwardly. The conduit section 14 is coaxially spaced apart from an inner peripheral wall of the lower conduit 5*c* and has a distal end 16 is opened toward the top of the main conduit 2. Namely, the conduit section 14 cooperates with the main conduit 5 to form a double conduit. The lower opening 4 at the bottom of the lower conduit 5*c* is externally provided with the nonreturn valve 6 adapted to be opened downwards.

With the snorkel 1 of such arrangement, a quantity of water flowing into the snorkel through the upper opening 3 during use of the snorkel as shown in FIG. 1 flows down along the inner peripheral wall of the main conduit 2 unless the quantity is excessively large. However, along the lower portion of the main conduit 2 defining the double conduit, the quantity of water does not flow into the conduit section 14 of the branch conduit 7 toward the mouthpiece 9 but flows toward the lower opening 4 and is collected there. Accordingly, a swimmer can easily breathe without being affected by the quantity of water collected in the proximity of the lower opening 4.

When a swimmer rises toward the water surface W and attempts to force out a quantity of water remaining within the snorkel by instantaneous vigorous expiration, the snorkel of the arrangement as has been described above enables the instantaneous vigorous expiration to be guided through the conduit section 14 of the branch conduit 7 toward the upper opening 3 and thereby the quantity of water to be forced out at once through the upper opening 3. Expired air thus guided does not flow toward the nonreturn valve 6 and therefore any apprehension is reliably avoided that the nonreturn valve 6 may be unintentionally opened and expiration may be utilized in vain.

According to the invention, the snorkel conduit forms the double conduit in the vicinity of the mouthpiece and a quantity of water flowing into the snorkel and then flowing down along the inner peripheral wall of the main conduit is not collected in the proximity of the mouthpiece. This unique arrangement can decrease a frequency at which a quantity of water collected in the snorkel should be forced out by expiration and thereby eliminate a swimmer's physical fatigue due to frequent expiration. Expired air flows upward from the mouthpiece through the double conduit structure opened toward the top of the main conduit. In this manner, expiration can be efficiently utilized to force out the quantity of water collected within the snorkel at once if through the upper opening.

What is claimed is:

1. A diving snorkel comprising:

a main conduit; and a branch conduit, said main conduit having an upper opening and a lower opening provided with a non-return valve positioned to be opened downwards, said branch conduit having:

a proximal end which enters into said main conduit and extends along a direction defined by a central axis of said main conduit;

a distal end opened toward said upper opening: and immediate portion which extends to said proximal end and is coaxially spaced apart form an inner peripheral wall of said main conduit and cooperates with said main conduit so as to form a double conduit.

2. A diving snorkel according to claim 1, wherein said main conduit includes an upper conduit, an intermediate conduit connected to said upper conduit and a lower conduit connected to the intermediate conduit.

3. A diving snorkel according to claim 2, wherein said branch conduit is branched from said lower conduit.

4. A diving snorkel according to claim 2, wherein said lower conduit and said branch conduit are integrally made of the same material.

* * * * *